US006619424B2

(12) United States Patent
Manrique et al.

(10) Patent No.: US 6,619,424 B2
(45) Date of Patent: Sep. 16, 2003

(54) SPEAKER ENCLOSURE CONFIGURED TO MINIMIZE DIFFRACTION

(75) Inventors: Pedro Manrique, Pasadena, CA (US); David Wathen, Los Angeles, CA (US)

(73) Assignee: Harman International Industries, Inc., Northridge, CA (US)

( * ) Notice: Subject to any disclaimer, the term of this patent is extended or adjusted under 35 U.S.C. 154(b) by 22 days.

(21) Appl. No.: 09/949,223

(22) Filed: Sep. 7, 2001

(65) Prior Publication Data

US 2003/0000767 A1 Jan. 2, 2003

Related U.S. Application Data

(60) Provisional application No. 60/302,830, filed on Jul. 2, 2001.

(51) Int. Cl.[7] ..... A47B 81/06
(52) U.S. Cl. ..... 181/199; 181/156
(58) Field of Search ..... 181/156, 199, 181/155, 144, 148, 147, 153

(56) References Cited

U.S. PATENT DOCUMENTS

| | | | | |
|---|---|---|---|---|
| D66,668 | S | 2/1925 | Bourne | |
| D73,363 | S | 8/1927 | Baker | |
| 4,128,738 | A | 12/1978 | Gallery | |
| 4,213,515 | A * | 7/1980 | Laupman | 181/145 |
| 4,611,686 | A * | 9/1986 | Kobayashi et al. | 181/156 |
| 4,650,031 | A * | 3/1987 | Yamamoto | 181/156 |
| 4,802,551 | A | 2/1989 | Jacobsen | |
| 4,964,482 | A | 10/1990 | Meyer | |
| 5,012,889 | A | 5/1991 | Rodgers | |
| D356,088 | S | 3/1995 | Jewitt et al. | |
| 5,402,502 | A | 3/1995 | Boothroyd et al. | |
| 5,933,509 | A | 8/1999 | Wu | |
| 6,367,579 | B1 * | 4/2002 | Wiener | 181/199 |

OTHER PUBLICATIONS

Article entitled: "Improvement in Dome Loudspeaker Characteristics by Using a Spherical–Wave–Front Horn Baffle" by Junichi Hayakawa, et al.; J. Audio Eng. Soc., vol. 36, No. 7/8, Jul./Aug. 1988.

Infinity's Modulus Home Theater System Owner's Guide, published approximately Feb. 2001.

* cited by examiner

*Primary Examiner*—Khanh Dang
(74) *Attorney, Agent, or Firm*—Squire, Sanders & Dempsey L.L.P.

(57) ABSTRACT

This invention provides a speaker enclosure that is configured to minimize diffractions from occurring. The speaker enclosure includes baffle that is tapered inward both in a vertical axis and a horizontal axis to provide a smooth transition for the wave fronts to propagate from the outer edge of the speaker housing to the atmosphere. Providing a smooth transition for the wave fronts minimizes the occurrence of eddy currents so that diffractions do not interfere with the quality of sound from the driver. To stabilize or control the wave fronts in the vertical axis, the baffle may be elongated in the vertical axis to sustain the wave front in that axis.

26 Claims, 4 Drawing Sheets

SPEAKER ENCLOSURE CONFIGURED TO MINIMIZE DIFFRACTION

CROSS-REFERENCE TO RELATED APPLICATIONS

This application is a non-provisional application claiming priority of U.S. Provisional Application Ser. No. 60/302,830, filed Jul. 2, 2001.

BACKGROUND OF THE INVENTION

1. Field of the Invention

This invention relates to a speaker enclosure for housing mid-range and high frequency transducers configured to minimize the diffraction that could interfere with wave fronts from its transducers.

2. Related Art

There are many types of speaker enclosures and each type can affect how sound is produced. Within a speaker enclosure is at least one driver (or transducer) that has a vibrating diaphragm for emitting sound waves in front of the cone. A baffle forms the front side of the speaker enclosure and has a wave guide that forms a smooth transition between the cone of the driver and the front side of the speaker enclosure. Moreover, a speaker enclosure may house a combination of drivers, such as mid-range and high frequency drivers, in one unit to keep the combination of drivers in a correct position so that they can work together.

One of the problems associated with a speaker enclosure is a phenomenon known as diffraction. Diffraction interferes with the quality of sound produced by the drivers. For example, a typical baffle may be substantially flat so that the speaker enclosure has a flat face. As the wave front propagates from the driver, it starts from the diaphragm and propagates along the wave guide and then along the outer edge of the speaker enclosure. Beyond the outer edge of the speaker enclosure, the wave front does not have a baffle to sustain the wave front and so it goes into free air. As the wave front transitions from the outer edge of the baffle to free air, there is an abrupt discontinuity to sustain the wave front. Such abrupt discontinuity, however, can cause eddy currents to occur in the wave front. Eddy currents may be generally described as whirl or circular currents of air running contrary to the steady flow of fluid causing a vortex. Eddy currents occur when there is a boundary layer separation between the wave front and the surface that is supporting the wave front. Eddy currents destructively add to the wave front such that the quality of sound is diminished. This phenomenon may be generally described as a diffraction. In particular, diffraction occurs from wave fronts that propagate from high frequency drivers because the velocity of wave fronts are higher, which further induces boundary layer separation to occur. As the velocity of the wave front increases, the momentum of the wave front may overcome the pressure forces holding the wave front to the support surface to cause boundary layer separation.

Another common shortfall of the speaker enclosure is the control of sound waves, both in horizontal and vertical axis. In the horizontal axis, a wide sound disbursement is preferred so that a listener can move from the center position without losing stereo image. In the vertical axis, however, the sound disbursement should be more controlled because listeners are typically limited in their vertical movements. In other words, a listener's movements are much more limited in the vertical axis than in the horizontal axis. Despite this distinction, speaker enclosures do not control or stabilize the sound waves in the vertical axis in order to improve the quality of sound. Therefore, there is still a need for a speaker enclosure that minimizes diffractions from occurring and provides a more stable or controlled sound disbursement in the vertical axis.

SUMMARY

This invention provides a speaker enclosure that is configured to minimize diffractions from occurring. To accomplish this, a portion of the baffle that is adjacent to a high frequency driver may be tapered inward to provide a smooth transition for the wave fronts to propagate from the outer edge of the speaker housing to free air. Providing a smooth transition for the wave fronts minimizes the occurrence of eddy currents so that diffractions do not interfere with the quality of sound from the driver. Moreover, the portion of the baffle that is adjacent to the high frequency driver may be curved and smooth to the outer edge of the baffle to further minimize diffractions from occurring.

To stabilize or control the wave fronts in the vertical axis, the baffle may be elongated in the vertical axis to sustain the wave front in that axis. That is, the elongated baffle in the vertical axis forms a surface that behaves as a wave guide to control and sustain the wave front in the vertical axis to enhance the quality of sound. However, in the horizontal axis, the baffle may be narrower than in the vertical axis so that the wave fronts may disperse more widely in the horizontal axis.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
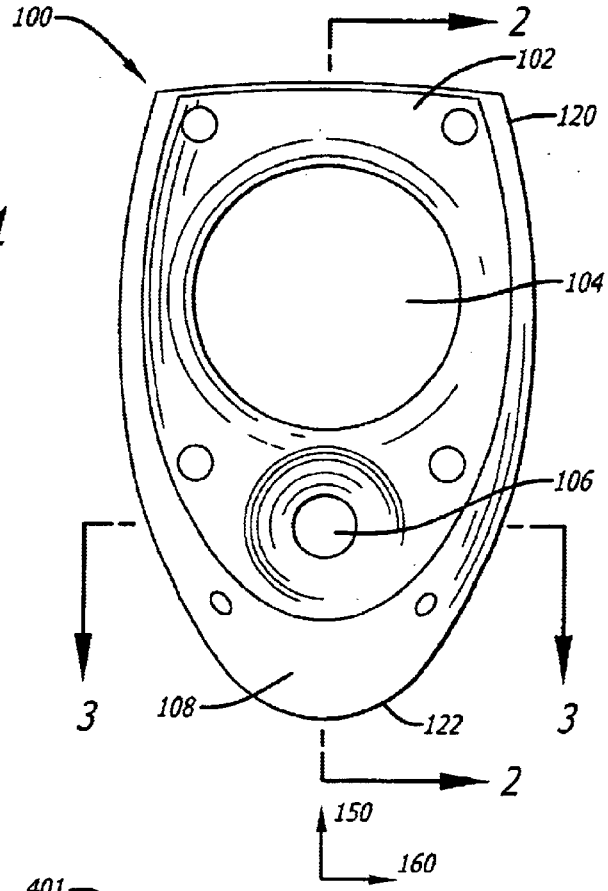
FIG. 1 is a front view of a speaker enclosure housing mid-range and high frequency drivers.

FIG. 1 illustrates a speaker enclosure 100 having a baffle 102 forming the front face of the speaker enclosure 100. The baffle 102 has a mid-frequency wave guide 104 and a high frequency (HF) wave guide 106 adapted to mate with a mid-range frequency driver and a high frequency driver, respectively. The mid-frequency driver may operate between about 100 Hz and about 2.5 KHz, and the high frequency driver may operate between about 2.5 KHz and 20.0 KHz. The baffle 102 may be elongated in the longitudinal axis 150 (or vertical axis) as compared to the horizontal axis 160. Moreover, the bottom portion 108 of the baffle 102 that is adjacent the high frequency range port 106 may be elongated to further sustain the wave fronts in the vertical axis to control the propagation of the sound wave in the longitudinal axis. In contrast, the baffle in the horizontal axis may be narrower than in the vertical axis to provide wider disbursements of the wave fronts in the horizontal axis.

FIG. 1 also shows the bottom edge 122 adjacent to the high frequency wave guide 106 in the longitudinal axis generally forming a curve such as a shape of a parabola. Forming a smooth surface along the bottom edge 122 removes any abrupt discontinuity which could cause eddy current from occurring. Therefore, the bottom edge has been curved to provide a smooth transition between the baffle 102 and the atmosphere for the wave fronts to minimize diffraction from occurring.

Figure 2:
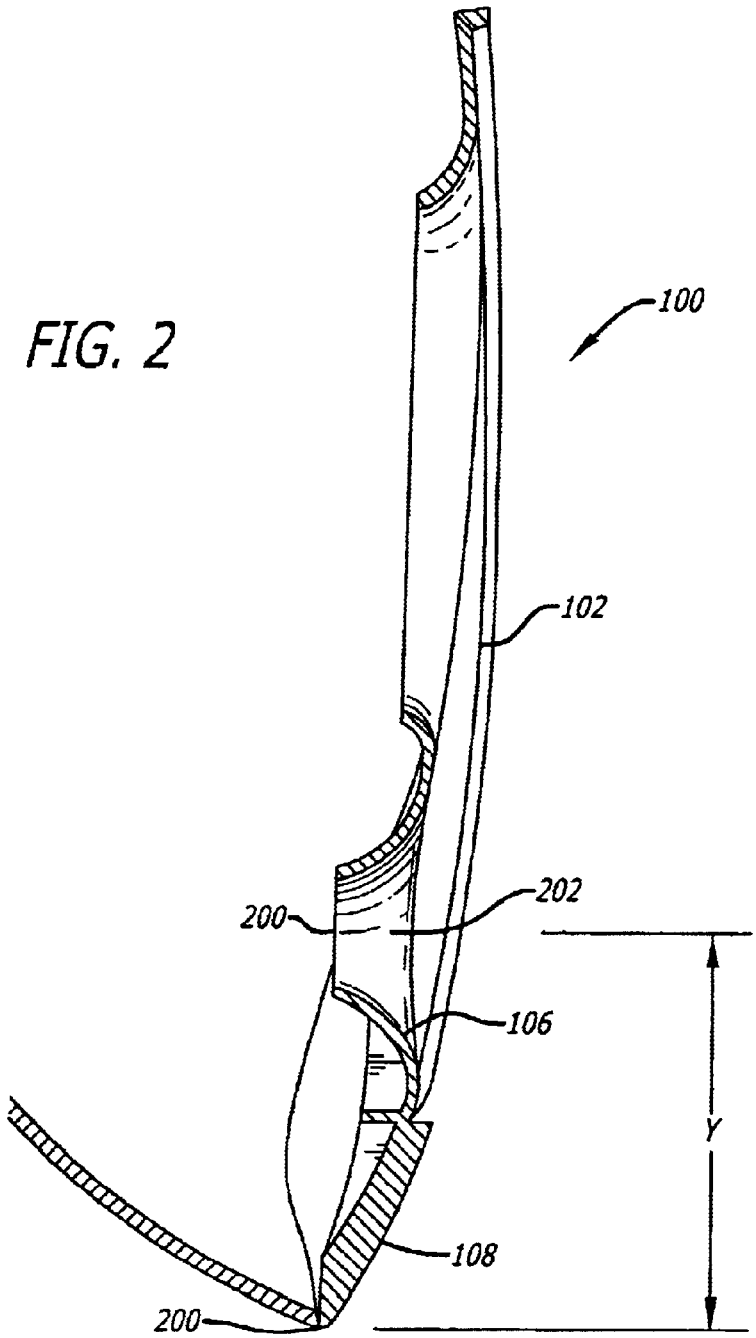
FIG. 2 is a cross-sectional view along line 2 in FIG. 1 of the speaker enclosure having an elongated bottom portion that tapers inward.
Figure 3:
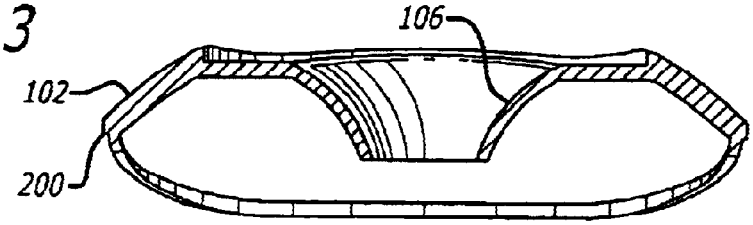
FIG. 3 is a cross-sectional view along line 3 in FIG. 1 of the speaker enclosure.

FIG. 2 illustrates a cross-sectional view of the baffle 102 along the vertical axis. And FIG. 3 illustrates a cross-sectional view of the baffle 102 along the horizontal axis. From both views, the baffle 102 provides a transition surface from the wave guide 106 to the edge 200 of the speaker housing 100. In particular, the baffle 102 tapers inward smoothly from the wave guide 106 to the edge 200 of the speaker housing 100 both in the vertical axis and the horizontal axis. This is done to minimize eddy currents from occurring along the edge of the speaker enclosure 100 as the wave fronts transition from the baffle 102 to the atmosphere. Moreover, the wave fronts from the HF driver may have a greater chance of inducing eddy current than the wave fronts from the midrange driver because the wave fronts from the HF driver propagate at higher frequencies and shorter wavelengths than the wave fronts of the mid-range driver. Besides frequency, the surface of the baffle can also influence this phenomena. To account for this, the baffle 102 may have more transition surface area around the HF wave guide 106 than around the mid-range wave guide 104 to minimize eddy currents from occurring around the HF wave guide 106. Accordingly, with the baffle 102 tapering smoothly inward from the wave guides to the edge 200 of the speaker enclosure 100, occurrence of diffraction which interferes with the quality of sound may be substantially reduced.

In addition to minimizing the occurrence of diffraction, the bottom portion 108 also sustains the wave front along the vertical axis 150 to control and stabilize the sound disbursement in the vertical axis. For example, the distance "Y" between the center of the wave guide 106 and the lowermost edge 200 may be about 3.5 inches. This means that wave lengths which are less than 3.5 inches may be affected by the bottom portion 108. For instance, since the HF driver operates above about 2.5 KHz, the longest wave length occurs at 2.5 KHz, which is about 1.3 cm (3.5 inches). Accordingly, the bottom portion 108 may act like an extension of the wave guide 106 to direct and stabilize the wave fronts propagating from the HF driver in the vertical axis. Since listeners are limited in their vertical movement generally between the sitting and standing positions, the sound disbursement may be stabilized and controlled between the two positions to improve the quality of sound in that listening zone. Accordingly, the bottom portion 108 minimizes the occurrence of diffraction and controls the disbursement of sound waves in the vertical axis to improve the quality of sound.

In the horizontal axis, the baffle 102 adjacent to the mid-range frequency driver may be narrow to provide wider disbursement of the sound waves in the horizontal axis. For instance, a mid-range driver may operate between about 100 HZ and 2.5 KHz. Accordingly, the shortest wave length from the mid-range frequency driver may be about 1.3 cm (3.5 inches), at 2.5 KHz. As illustrated in FIG. 1, along the horizontal axis 160, the distance between the mid-range wave guide 104 and the outer edge 120 is substantially less than 3.5 inches. This means that the baffle 102 does not interfere with the wave fronts along the horizontal axis.

The baffle 102 forms a smooth transition from the wave guide 104 to the outer edge of the baffle 120 to minimize eddy currents from occurring. With the baffle forming a smooth transition from the wave guide 104 to the outer edge 120, and not interfering with wave fronts from the mid-range driver, the mid-range driver may substantially perform as a point source driver without the interference from diffraction. This way, the mid-range driver in the speaker enclosure 100 provides a wide horizontal stereo coverage so that a listener may move in a horizontal axis and hear a high quality stereo image. Additionally the speaker enclosure houses the mid-range and HF drivers to optimize the performance of the two drivers.

Figure 4:
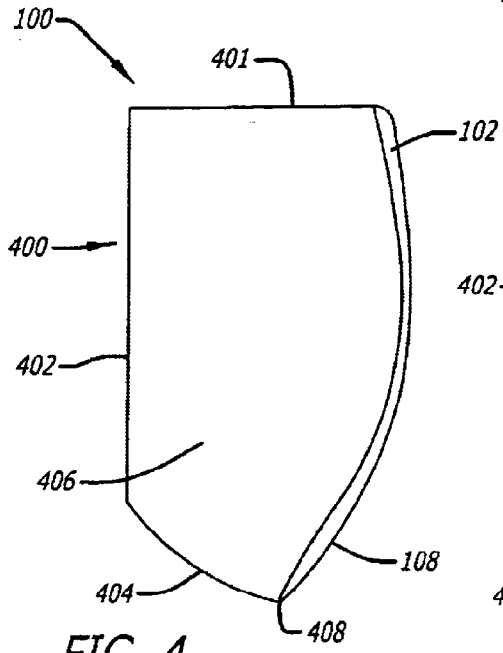
FIG. 4 is a side view of the speaker enclosure.
Figure 5:
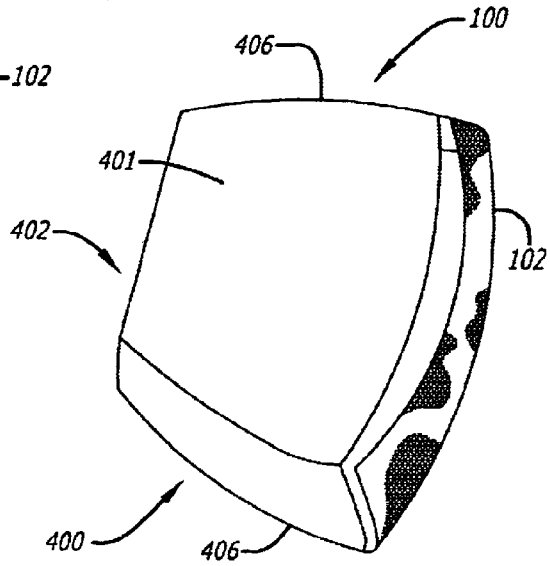
FIG. 5 is a top view of the speaker enclosure.

FIGS. 4 and 5 illustrate a back housing 400 enclosing mid and high frequency drivers. And the speaker enclosure 100 may be manufactured as the following. The back housing 400 may be molded using plastic material to enclose the mid and high frequency drivers. The back housing 400 may be configured so that the back side 402 has a smaller surface area than the front baffle 102. As such, the side walls 406, the top side 401, and the bottom side 404 all taper inward towards the back side 402. This allows the wave front from the drivers to wrap around the outer surfaces of the speaker enclosure 100 with minimal diffraction, if at all. The front baffle 102 may be molded with a plastic material as well. The front baffle 102 may be configured to mate with the opening of the back housing 400 so that the two combination substantially seal the two drivers.

The front baffle 102 may be molded to forms a convex surface and may be the largest surface of the speaker enclosure 100. In other words, the front baffle may be configured to gradually curves to the edge of the speaker enclosure to provide a smooth transition for the wave fronts from the surface of the baffle to the edge of the speaker enclosure. The edge of the front baffle 102 may be rounded forming a smooth curve like a parabola and half circle. The bottom portion 108 of the front baffle 102 may be elongated along the longitudinal axis to act as an extension of the high frequency wave guide. In particular, the wave front 102 may be molded so that the bottom portion 108 is at least as long as the longest wavelength from the high frequency driver to direct and stabilize the wave front in the vertical axis.

Figure 6:
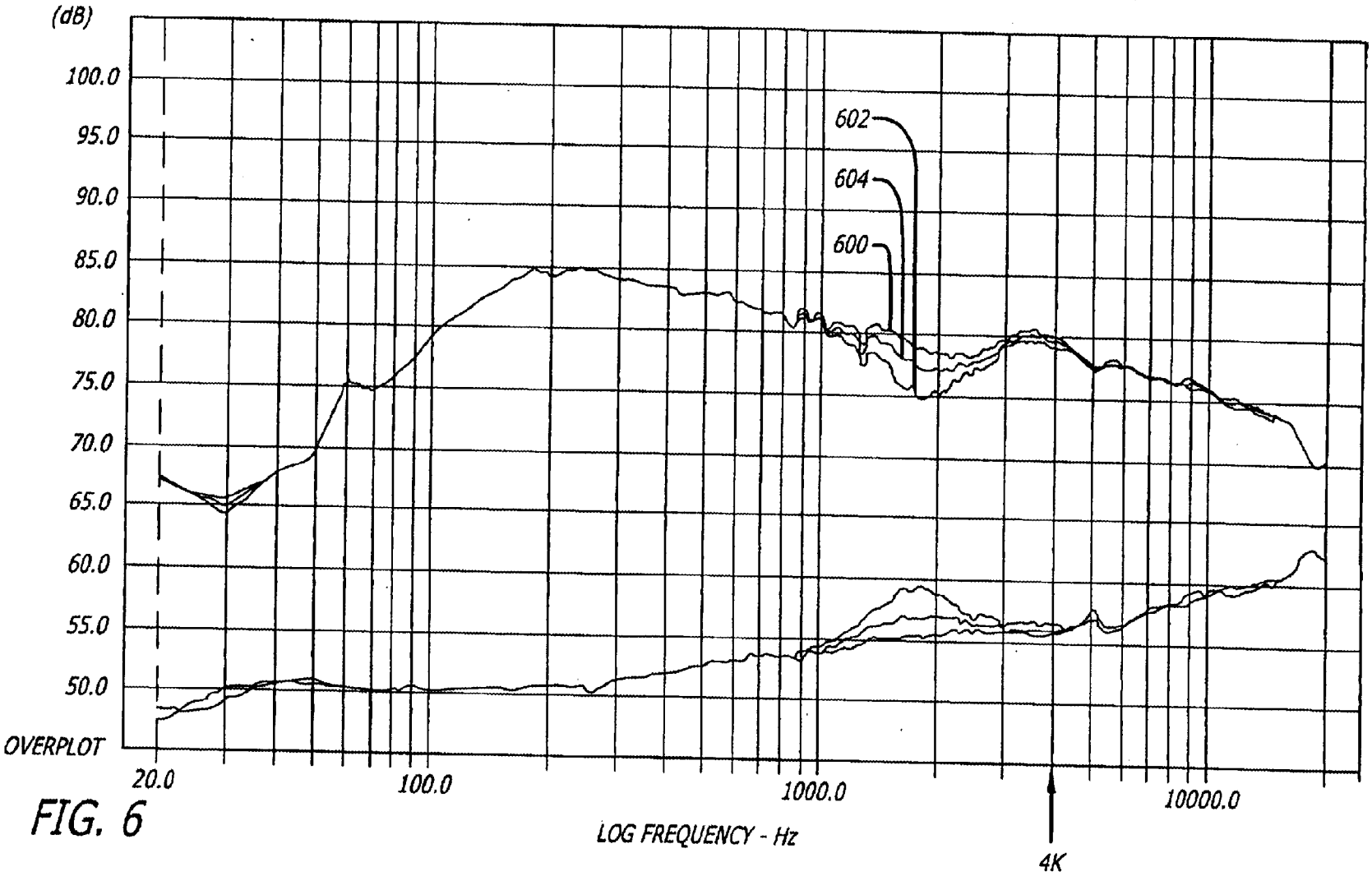
FIG. 6 is a graph illustrating performance characteristics of a rectangular speaker enclosure.
Figure 7:
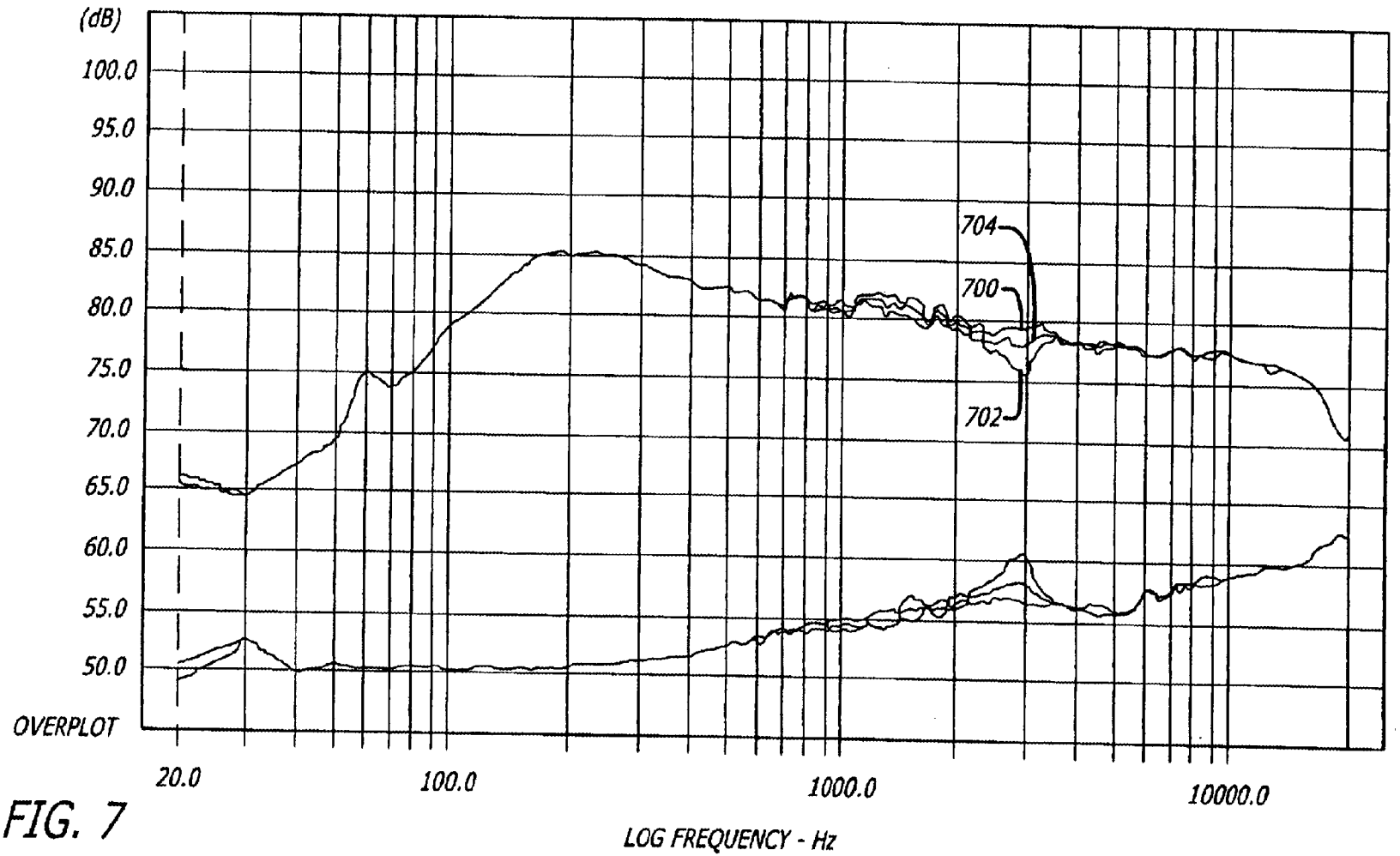
FIG. 7 is a graph illustrating performance characteristics of a speaker enclosure according to the invention.

FIG. 6 illustrates performance curves for a rectangular speaker enclosure housing the same mid-range and HF drivers arranged substantially similarly as in the speaker enclosure 100. The rectangular speaker enclosure tested had the following dimensions: height of about 7.7 inches, width of about 5.5 inches, and depth of about 4.5 inches. FIG. 7 illustrates performance curves for the same test conducted in FIG. 6, except that the mid-range and HF drivers are housed in the speaker enclosure 100.

FIG. 6 shows three curves, in particular: a curve 600, which is an average of all the measurements taken around the rectangular enclosure in a 360° sphere in the horizontal axis; a curve 602, which is an average measurement taken around the rectangular enclosure in a 360° sphere in the vertical axis; and a curve 602, referred to as a power curve, is an average of the two horizontal and vertical average curves 600 and 602. For the rectangular enclosure, there is about 5 dB difference (80.0 dB–75.0 dB) between the two curves 600 and 602 in the frequency range from about 1.0 KHz to about 4 KHz. In other words, there is a large swing between the horizontal and the vertical dispersions between the frequency range of 1.0 KHz and 4 KHz, which can cause a shift in the sound quality as a listener moves in the vertical direction by sitting down, for example. Such a shift can cause the sound quality and sound stage to collapse which is noticeable to a listener.

FIG. 7 shows three curves for the test conducted on a speaker enclosure 100: a curve 700, which is an average of measurements taken around the speaker enclosure 100 in a 360° sphere in the horizontal axis; a curve 702, which is an average measurement taken around the speaker enclosure 100 in a 360° sphere in the vertical axis; and a power curve 702, which is an average of the two horizontal and vertical average curves 700 and 702. Here, there is about 3.5 dB difference (79.5 dB–76 dB) between the two curves 700 and 702, so that the shift in the vertical dispersion is not as noticeable as the rectangular enclosure. In the speaker enclosure 100, the shift may occur in a much narrower frequency range than with the rectangular enclosure. For instance, with the speaker enclosure 100, the shift may occur between about 2.5 KHz and about 3.5 KHz. However, with the rectangular enclosure, the shift may occur in the much wider range of 1.0 KHz to 4.0 KHz. Since a listener's ears are more sensitive to a shift in a wider frequency range, the shift for the speaker enclosure 100 may be less noticeable than with the rectangular enclosure.

Another noticeable performance characteristic between the rectangular enclosure and the speaker enclosure 100 is the sound power curves 604 and 704. In FIG. 6, the power curve 600 has a dip at about 2.0 KHz and a peak at about 3.5 KHz. The dip at 2.0 KHz generally signifies a crossover from the mid-frequency driver to the HF driver, which is noticeable with the rectangular enclosure. In contrast, in FIG. 7, the power curve 704 shows a gradual transition without the dips and peaks, which means that there is little evidence of crossover with the speaker enclosure 100. This means that when designing a crossover network to filter the mid-frequency from the high frequency, less electronic components are needed to deal with the crossover effect. Using less components of course means less cost to produce the speaker system coupled with an improvement in the sound quality.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A speaker enclosure, comprising:

a back housing having an opening, and a plurality of side surfaces, where the plurality of side surfaces taper inward towards a back surface; and a baffle enclosing the opening of the housing, tapering inward smoothly in a horizontal axis and a vertical axis and having an outer edge;

a high frequency wave guide associating with a high frequency driver and is located adjacent to the baffle where the baffle is elongated and tapers inward; and a mid frequency wave guide associating with a mid frequency river.

2. The speaker enclosure according to claim 1, wherein the baffle has a horizontal transition surface adjacent to the mid frequency wave guide that is narrower than a transition surface adjacent to the high frequency wave guide.

3. The speaker enclosure according to claim 1, wherein the outer edge of the baffle forms a parabola.

4. A speaker enclosure, comprising:

a back housing having an opening; and a baffle tapered inward in a horizontal axis and a vertical axis and adapted to enclose the opening, the baffle having a high frequency wave guide associating with a high frequency driver and a mid frequency wave guide associating with a mid frequency driver.

5. The speaker enclosure according to claim 4, wherein the baffle has a portion along the longitudinal axis adjacent to the high frequency wave guide and having a length between a focal point of the high frequency wave guide and an edge of the baffle that is greater than a longest wavelength from the high frequency driver acting to stabilize wave fronts from the high frequency driver in the vertical axis.

6. The speaker housing according to claim 4, wherein the length is at least about 3.5 inches.

7. The speaker enclosure according to claim 4, wherein the high and mid frequency drivers have a cross over between about 2.0 KHz and 3.0 KHz.

8. The speaker enclosure according to claim 4, wherein the mid frequency driver operates in the frequency range between about 100 HZ and 2.5 KHz.

9. The speaker enclosure according to claim 4, wherein the high frequency driver operates above about 2.0 KHz.

10. The speaker enclosure according to claim 4, wherein the baffle has a portion that is adjacent to the high frequency wave guide, wherein the portion forms a parabola along an edge of the baffle in a longitudinal axis.

11. The speaker enclosure according to claim 4, wherein the baffle has a horizontal transition surface adjacent to the mid frequency wave guide that is narrower than a transition surface adjacent to the high frequency wave guide.

12. The speaker enclosure according to claim 4, wherein the back housing has a bottom side that taper inward.

13. The speaker enclosure according to claim 4, wherein the back housing includes a topside, a bottom side, and left and right sides all tapering inward towards a back side.

14. A method for manufacturing a speaker enclosure, comprising:

adapting a baffle to associate with a mid frequency and high frequency drivers;

inwardly tapering the baffle; and elongating a portion of the baffle that is adjacent to a high frequency wave guide along a vertical axis.

15. A method according to claim 14, further including:

rounding an edge of the baffle adjacent to the high frequency wave guide in a longitudinal axis.

16. A method according to claim 15, wherein the edge forms a parabola shape.

17. A method according to claim 14, further including:

enclosing the baffle to house the mid and high frequency drivers, where the enclosure has a plurality of inwardly tapering walls to encompassing the mid and high frequency drivers.

18. A method according to claim 14, wherein the elongating the portion of the baffle is substantially an extension of the high frequency wave guide to direct and stabilize wave fronts from the high frequency driver.

19. A method according to claim 18, wherein the elongating the portion of the baffle is at least as long as a longest wavelength propagating from the high frequency driver.

20. A speaker enclosure for housing a high frequency driver and a mid frequency driver, comprising:

a back housing having an opening; and a baffle enclosing the opening of the back housing, the baffle having a high frequency wave guide for the high frequency driver and a mid frequency guide for the mid frequency driver, where the baffle adjacent to the high frequency wave guide tapers inward.

21. The speaker enclosure according to claim 20, where the baffle is elongated along an longitudinal axis to increase to the transition surface area adjacent to the high frequency wave guide.

22. The speaker enclosure according to claim 20, where the baffle forms a smooth transition from the high frequency wave guide to the edge of the baffle.

23. The speaker enclosure according to claim 20, where the back housing has a back side that has a smaller surface area than the baffle.

24. The speaker enclosure according to claim 20, where the back housing has a back side, and the back housing tapers inward towards the back side.

25. A method for housing a high frequency driver and a mid range driver to minimize eddy currents from occurring, comprising:

transitioning a baffle smoothly from a high frequency wave guide to the edge of a back housing;

transitioning the baffle smoothly from a medium frequency wave guide to the edge of the back housing; and increasing the transitioning area from the high frequency wave guide to the edge of the back housing along an elongated axis.

26. The method according to claim 25, further including:

tapering the back housing towards the back side of the back housing.

* * * * *